United States Patent [19]

Kirkbride

[11] 4,148,614

[45] Apr. 10, 1979

[54] PROCESS FOR REMOVING SULFUR FROM COAL

[76] Inventor: Chalmer G. Kirkbride, 13 Elk Forest, R.D. #2, Elkton, Md. 21921

[21] Appl. No.: 896,003

[22] Filed: Apr. 13, 1978

[51] Int. Cl.[2] ..... C10L 9/10; C10B 57/00; C10C 1/08

[52] U.S. Cl. ..... 44/1 R; 201/17; 423/358

[58] Field of Search ..... 44/1 R; 201/17; 208/8; 423/358

[56] References Cited

U.S. PATENT DOCUMENTS

| | | | |
|---|---|---|---|
| 2,726,148 | 12/1955 | McKinley et al. | 44/1 R |
| 3,503,865 | 3/1970 | Stone | 208/8 X |
| 4,076,607 | 2/1978 | Zavitsanos et al. | 44/1 R |

*Primary Examiner*—Carl Dees

*Attorney, Agent, or Firm*—Dann, Dorfman, Herrell and Skillman

[57] ABSTRACT

A process for decreasing the sulfur content of coal is provided, which includes forming a slurry of coal particles in an inert solvent, and subjecting the slurry in admixture with hydrogen to the influence of wave energy in the microwave range.

8 Claims, 1 Drawing Figure

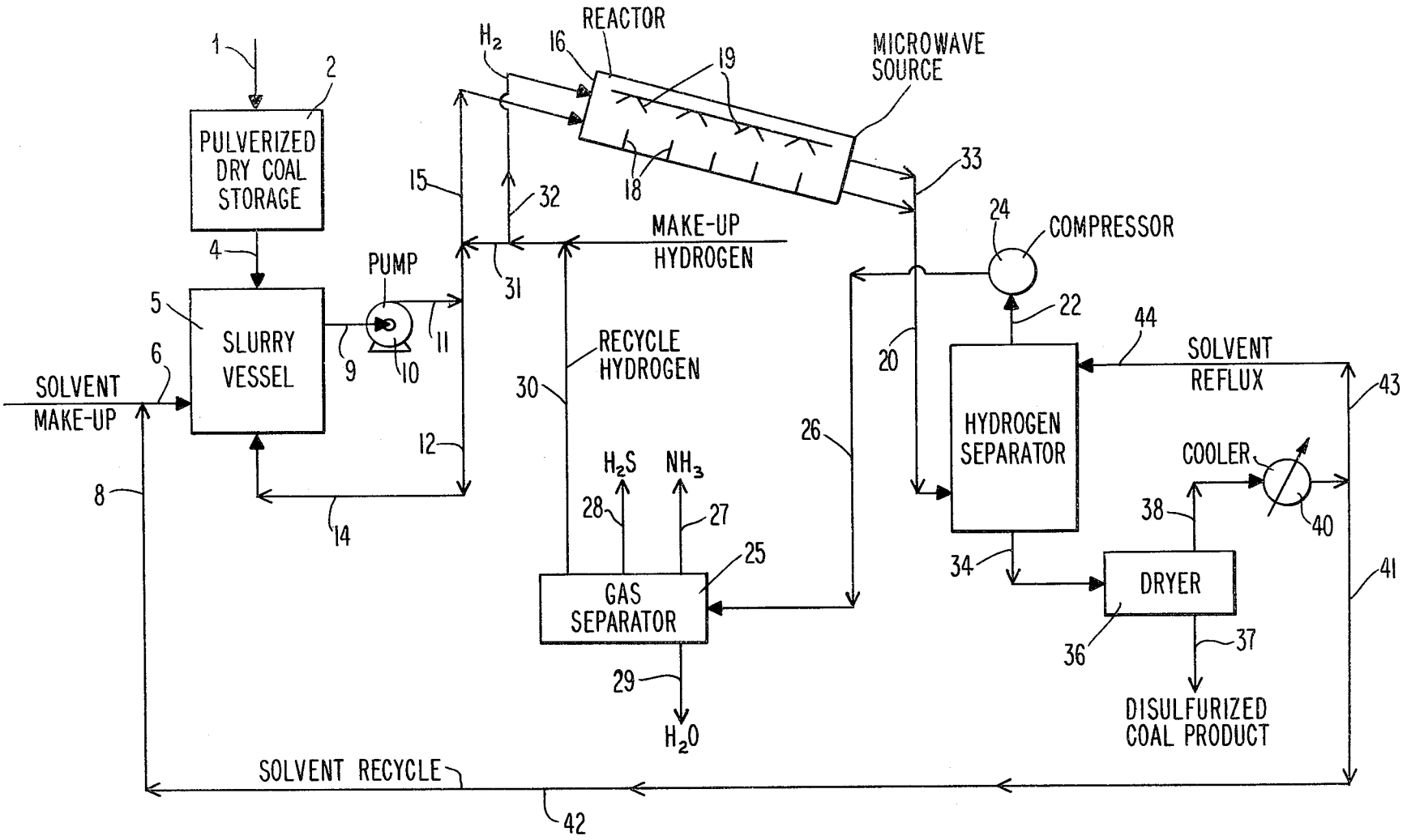
PULVERIZED DRY COAL STORAGE
SLURRY VESSEL
PUMP
SOLVENT MAKE-UP
SOLVENT RECYCLE
REACTOR
MICROWAVE SOURCE
$H_2$
MAKE-UP HYDROGEN
RECYCLE HYDROGEN
COMPRESSOR
HYDROGEN SEPARATOR
GAS SEPARATOR
$NH_3$
$H_2S$
$H_2O$
SOLVENT REFLUX
COOLER
DRYER
DISULFURIZED COAL PRODUCT

PROCESS FOR REMOVING SULFUR FROM COAL

BACKGROUND OF THE INVENTION

My patent application Ser. No. 831,170, filed Sept. 7, 1977 for "Sulfur Removal from Coal" is directed to reducing the sulfur content of coal by drying coal particles and subjecting a mixture thereof with hydrogen to microwave energy. My patent application Ser. No. 831,171, also filed Sept. 7, 1977, for Shale Conversion Process, is directed to converting the kerogen of shale to oil products by drying the shale and subjecting a mixture thereof and hydrogen to microwave energy.

The present invention also relates to a process for decreasing or eliminating the sulfur content of coal. As described in said Ser. No. 831,170, the presence of sulfur in coal causes many industrial and environmental problems. For example, the burning of coal for any purpose, such as the production of electricity, is generally legally limited to coal containing a relatively small amount of sulfur so that the emission of sulfur gases is maintained below specified limits. This is necessary because the production of noxious gases such as $SO_2$ has an adverse effect on the environment. Many coals contain substantially more sulfur than is permissible for burning. Heretofore, attempts to lower the sulfur content such as by reaction with hydrogen, usually in the presence of a solvent and a hydrogenation catalyst, have not found commercial success, and certain of these processes are destructive of a portion of the coal by conversion thereof to undesired gaseous or liquid products. An alternative method to sulfur removal from coal is to remove noxious gases from the stack gases, and although a great amount of time and money has been spent to develop a suitable process and equipment, only limited commercial success has been obtained. Also, the blending of high sulfur coal with low sulfur coal to bring the sulfur content of the blend to usable limits is not satisfactory in requiring large amounts of very low sulfur content coal.

The presence of nitrogen and oxygen in coal is also undesirable. On burning the coal, the nitrogen is converted to nitrogen oxide gases, or to particulate matter which are undesirable and their release to the atmosphere regulated. The removal of oxygen from coal upgrades the coal by increasing its heating value, i.e., by increasing the British Thermal Units (BTU) obtained per pound of coal on burning.

An object of the invention is to provide a novel process for decreasing the sulfur content of coal in a facile and economical manner.

A specific object of this invention is to provide a novel process for the substantial removal of sulfur from coal without concomitant conversion of appreciable amounts of coal to other products.

A further object is to provide a novel process for contacting dried coal particles slurried in an inert solvent with hydrogen under conditions whereby the hydrogen reacts with the sulfur contained in the coal to produce hydrogen sulfide, thereby reducing the sulfur content of the coal.

A still further object is to provide a novel process for simultaneously decreasing the sulfur, nitrogen and oxygen content of coal.

In an embodiment of the invention, coal particles are dried, slurried in a dry solvent inert to hydrogen, the slurry mixed with hydrogen at an elevated pressure, and the mixture exposed to wave energy in the microwave range. Under the influence of the microwaves, the hydrogen and sulfur react to form hydrogen sulfide which is removed by dissolution or dispersion in the solvent so that the coal particles have a significantly reduced sulfur content. Also, under the influence of the microwaves, the nitrogen and hydrogen may react to form ammonia and the oxygen and hydrogen react to form water, so that the coal particles have a significantly reduced oxygen content and may have a reduced nitrogen content.

DETAILED DESCRIPTION OF THE INVENTION

The coal which can be used in the present process is preferably bituminous coal, but all types of coal can be used, such as lignite and sub-bituminous coal. In general, any naturally occurring solid carbonaceous material including oil shales and tar sands gives good results in the present process although equivalent results are not necessarily obtained. For convenience, the invention will be described using "coal,"it being understood this term is intended to include the foregoing materials. Coal for use in the process of the invention may vary very substantially in composition. On a dry basis, in weight percent, sulfur will usually be from 0.7 to 9%, oxygen from 4 to 40%, and nitrogen from 1 to 4%. It is desired to reduce the sulfur content to not over 0.7 weight percent and preferably to 0.1 weight percent, and where desired the sulfur content may be reduced to as low as 0.01 weight percent (all on a dry basis). Although removing sulfur from coal is the primary objective of the invention, when reducing the sulfur content to the defined levels, the oxygen content will also be reduced and the nitrogen content may be reduced to be well within acceptable levels and to meet foreseeable environmental standards.

For use in the process of the invention, the coal is in particle form of a size suitable for forming a slurry in an inert hydrocarbon solvent. A particle size which will pass a 100 mesh screen gives good results, and generally the particle size will be from 200 mesh (i.e. 90% will pass a 200 mesh screen) to 50 mesh. The size of the coal particles is not important except that it affects in some measure the ease of preparing and maintaining the slurry and the operating conditions and therefore the overall economics of the process, as hereinafter described. Apparatus to use for crushing, grinding or otherwise pulverizing a coarse coal feed for use in the present process may be of type known to those skilled in the art, such as ball mills, rod mills, roller crushers, and the like.

In accordance with the present invention, it is important that the coal be substantially dry prior to forming the slurry thereof with solvent. By "dry coal,"and terms of similar import, is meant coal from which substantially all of the free moisture has been removed. While it is not desired to be bound by theoretical considerations, in the present process wherein a mixture of dry coal, an inert solvent, and hydrogen is subjected to the influence of microwaves, it is believed that the wave energy causes a localized temperature rise at the situs of each sulfur atom and activates the sulfur atoms so that they react with the adjacent hydrogen which may be dissolved or dispersed in the solvent to form hydrogen sulfide which is ultimately removed from the system as a gas. If water molecules (free moisture) are present throughout the coal particles, they are activated by the wave energy causing a significant increase in the temperature of the entire coal particle and therefore the solvent, which is an inefficiency in energy use, may result in the conversion of coal molecules to undesired liquid or gaseous products, and contaminates the solvent. While the form in which the sulfur may exist in coal is believed to vary substantially and is not known with certainty, it may be of mineral origin or may form a part of an organic molecule, such as forming a part of a heterocyclic molecule. What is known is that the sulfur content of coal is eliminated or at least markedly reduced in accordance with the present invention.

The coal may be dried by any convenient means, and the drying may be performed before or after the coal is pulverized to the final desired size. Usually it is preferred to dry the coal while from "pea" size up to one inch average diameter, as such sizes are more easily handled for drying than the smaller particle sizes. Preferably the coal particles to be dried are heated to about 250° F. to drive off free moisture. Depending on the particle size and agitation of the particles, this may require from about 15 to 60 minutes. This time and temperature can be substantially and advantageously reduced by applying a vacuum while heating. Other drying techniques which are known to those skilled in the art, such as by passing a dried inert gas through the heated bed of coal particles, gives good results. Suitable gases include inert gases that will not react chemically with the coal at drying conditions, including hydrogen and nitrogen. After drying, it is advantageous, where particles larger than of the final size are dried, to maintain the dry inert atmosphere during pulverizing to insure that the particles remain substantially free of moisture. Coal may initially contain from 1 to 50% by weight or more of moisture, with bituminous coal generally containing from 1 to 20% moisture. To secure the advantages of the present process, the moisture content should be reduced to not more than 0.5%, and preferably to below 0.2% by weight.

By "solvent", "dry solvent," "inert solvent," "hydrocarbon solvent," and terms of similar import, as used herein to refer to the liquid reaction medium of the process, is meant a fluid which is a liquid under the conditions of the slurry formation and exposure to microwave energy, which is inert to hydrogen and to coal components under the said conditions, and which has at most a very small water content. The preferred solvent is a mixture of saturated hydrocarbons, i.e., hydrocarbons of the paraffinic series. Petroleum distillates boiling within the range of from about 100° F. to about 700° F. and preferably between 400° F. and 600° F. give good results. Such distillates may be in the gasoline or fuel oil ranges and where necessary are subjected to separation and/or hydrogenation processes prior to use in the present process to eliminate by separation aromatic hydrocarbons and naphthenic hydrocarbons, or to convert them to paraffinic hydrocarbons. Such hydrogenation and separation processes are well known in the art and do not form a part of the present process. Also where necessary, moisture is removed from the solvent prior to use by any convenient means, such as with a solid absorbent as is also well known in the art. The solvent to use should not contain a significant amount of free (undissolved) moisture although a moisture content as high as 0.5% weight percent does not appear to adversely affect the process. It is of importance to avoid the presence, in the solvent, of hydrocarbons reactive to hydrogen as hydrogen is thereby consumed, although a small amount, say up to 10% by volume, of hydrocarbons having olefinic unsaturation which are at least partly saturated under the conditions of the process to become non-reactive to hydrogen may be present initially in the solvent and/or in make-up solvent. It is of particular importance to avoid the presence of the hydrogen donor type hydrocarbons as this may lead to undesired conversion of the coal as taught in U.S. Pat. No. 2,503,865.

The coal slurry with hydrogen is subjected to the influence of wave energy in the microwave range. It is essential to the invention that hydrogen be in the immediate vicinity of the activated sulfur atom (or nitrogen or oxygen atom) for reaction to occur. The hydrogen in the vicinity of the activated sulfur, nitrogen or oxygen atom may be dissolved in the solvent or may be in gaseous form in the nature of a fine dispersion such as finely divided bubbles, or both. Under relatively high hydrogen pressures, the amount of dissolved hydrogen becomes greater, whereas at relatively low hydrogen pressures vigorous agitation can maintain the hydrogen in the form of highly dispersed bubbles to great advantage in the process, as more fully described hereinafter. The temperature of the reaction mixture also affects the amount of hydrogen dissolved, with low temperatures favoring a high quantity of dissolved hydrogen, and has other favorable effects on the process also as more fully described hereinafter. Generally under most conditions of temperature and agitation, a pressure of from about 5 psi (pounds per square inch) to about 10,000 psi will give good results.

The time of exposure of the coal slurry and hydrogen to microwaves is dependent largely upon the effectiveness of the microwaves in activating the sulfur atoms and the intimacy of association between the sulfur atoms and hydrogen. Also important is the power of the microwave generator per ton of coal per day processed and the distance through the solvent the microwaves must travel before contacting a coal particle. Preferably the geometry of the reactor, coal to solvent ratio, residence time in the reactor, and agitation are such that substantially all of the coal particles while in the reactor will be subjected for at least a fraction of a second to microwaves having a path of not more than four and preferably no more than two inches to travel through the solvent. A time of from 5 to 60 seconds generally will be used with good results, but shorter times where good sulfur atom-hydrogen intimacy is obtained down to about 0.1 second may be used. With lower hydrogen pressures, say about 5 psi to 50 psi, as much as 10 minutes may give optimum results, but longer times should be avoided because of inefficient energy usage and the formation of undesirable products from the coal, and generally increased agitation can be used to provide hydrogen in the form of a dispersion instead of dissolved hydrogen at the low pressures.

The temperature to employ during exposure of the coal-solventhydrogen mixture to wave energy is not critical to the process. It is believed that the activation of the molecules and possibly very localized temperature rises, namely in the immediate vicinity, or situs, of the sulfur, nitrogen or oxygen atoms, as herein described, makes unimportant the overall temperature of the coal particle bed. Accordingly, ambient temperature is advantageously used. Where coal drying is at an elevated temperature and exposure of the dried coal-hydrogen to wave energy follows soon thereafter, the elevated temperature may assist the desulfurization reaction to an extent, but relatively high temperatures for the coal particles, say above about 300° F., should be avoided as cracking and the conversion of part of the coal to products undesired in the present process will be observed. In general, the overall temperature of the coal slurry during the desulfurization reaction is ambient and will be between about 40° F. and 200° F.

The wave energy to use in the present process is in the microwave range and may be from 1 megacycle per second to 1000 gigacycles per second ($10^6$ to $10^{12}$ cycles per second, respectively). These frequencies may be expressed using the Hertz (Hz) Unit, and are the same as from 1 megahertz (1MHz) to 1000 gigahertz (1000GHz). As used herein, "megacycles" means "megacycles per second" unless otherwise stated. With some coals it may be advantageous to use two or three or even more frequencies simultaneously or consecutively, as this may be the most efficient operation. While again it is not desired to be limited by theoretical considerations, it is believed that a single frequency does not give optimum activation of all types of sulfur atoms. Thus, the sulfur atom of an aliphatic-type molecule may receive maximum activation at one frequency, while the sulfur atom contained in the ring of an aromatic-type molecule may receive maximum activation at a different frequency. For simultaneous operation, two or more wave energy sources are used at the same time. For consecutive operation, the same coal slurry admixed with hydrogen is subjected to wave energy of different frequencies at different times, usually one immediately following the other. An alternative means for consecutive operation which is especially useful where the coal slurry masses through an elongated reactor is to space wave energy sources of different frequencies along the path of the coal slurry in the reactor. When using different frequencies, the total time of exposure of the coal slurry and hydrogen to the wave energy will be relatively short because of the high efficiency of the operation, so that times of exposure in the lower portions of the defined range give good results. The desirability of using a multiplicity of wave energy sources and the frequencies to use are best determined by experimentation for a given coal. The equipment for generating microwaves is well known to those skilled in the art. Continuous wave magnetrons with accompanying electronic equipment gives good results, and the choice and use of such equipment will be apparent to those skilled in the art.

Oxygen occurring as a component of carbonaceous molecules (the naturally occuring coal molecules including carbon and hydrogen atoms), as distinguished from the oxygen of the free moisture which is removed in the drying step of the process, is also removed in the present process by the reaction of the oxygen atom with hydrogen under the influence of wave energy. This is a desirable reaction in that the coal is thereby freed of combined oxygen which increases the heating value of the coal, and the reaction does not result in a significant rise in temperature of the entire coal body apparently because of the limited amount of oxygen present and the removal of the water as formed as vapor. Every one percent reduction in the oxygen content of the coal corresponds to about 65 BTU/lb increase in net heating value. Thus, with coal having a heating value of 12,000 BTU/lb, a 5% reduction in oxygen content will increase the heating value to over 12,300 BTU/lb. The water formed is a solvent contaminant and must be removed therefrom. Oxygen as a component of carbonaceous molecules may be in the ring structure of five or sixmembered rings, the other ring members being carbon, or in ether form as where aromatic units are interlinked through the oxygen, or in a hydroxyl group which may be a phenolic hydroxyl, or in carbonyl groups, or otherwise.

Nitrogen occurring as a component of the coal carbonaceous molecules probably exists as an occasional heterocyclic ring and to some extent as amine groups. As above discussed for oxygen, nitrogen is also removed in the present process by the reaction of the nitrogen atoms, activated by the microwaves, with hydrogen to form ammonia which is removed in the gas phase from the coal slurry. When it is desired to reduce the nitrogen content of coal, together with sulfur, operation should be in the upper pressure range to achieve good results. Pressures of above about 2500 psi give good results, with the amounts removed becoming smaller at lower pressures. This ammonia may be recovered from the system by known means, such as fractionation from the solvent, and forms a product, e.g., it can be used as the source of low-cost fertilizer. Also, in some instances the ammonia as formed will be decomposed in the reactor to supply hydrogen to the process, and if desired, ammonia in substantial amounts can be added to form a source of hydrogen for the process.

On completion or substantial completion of sulfur removal from coal according to the invention, the desulfurized coal is recovered from the solvent by any known means such as drying, filtering, or decanting, or a combination thereof. The solvent contains dissolved and/or dispersed hydrogen, hydrogen sulfide, water and ammonia, and is treated by known means to purify the solvent, which is recycled to the process. The solvent contaminates are recovered generally as a mixture of gases, and hydrogen is recovered therefrom and recycled to the process. Ammonia, if present, can also be recovered for use as a fertilizer or otherwise. For example, an absorption system including ethanolamine gives good results in purifying the hydrogen, and additional absorbants as known to those skilled in the art can be used, as can the techniques of fractionation and distillation. The recovered coal is suitable for use in any process where a low sulfur-content coal is required.

In an embodiment of the invention, after the exposure to microwaves, dissolved gases are removed from the coal slurry by any means such as by heating, subjecting to a vacuum, or both, or by displacement with an inert gas such as nitrogen. The coal-solvent slurry consisting of a substantially paraffinic solvent and coal particles with the entire system substantially sulfur-free forms a product of the invention. Advantageously this product of the invention comprises a mixture of paraffinic hydrocarbons boiling within the range of from about 400° F. to 700° F. and contains from about 10% to 75% by weight of coal particles of a size so that at least 90% thereof will pass a 100 mesh screen, the entire system being substantially free of sulfur, say having a sulfur content of less than 0.5 weight percent of the slurry, and preferably less than 0.1 weight microwave source 19. Microwave source 19 can be a single or a multiple source, and if a multiple source, can be of the same or advantageously of different wavelengths, as herein described. Hydrogen is passed by line 32 through the vapor space between the slurry in reactor 16 and microwave source 19. The linear velocity of the hydrogen is a minimum of one foot per second and preferably is not less than 10 feet per second. The purpose of this is to minimize or prevent the microwave tube from being contacted by the slurry. A very slight charing or dirt on the surface of the microwave tube will have a mirror effect upon microwave energy transmission. The recycle hydrogen is removed from reactor 16 by lines 33 and 20 and passed to hydrogen separator 21. The slurry, after exposure to the microwaves, exits from reactor 16 through line 20 and flows into hydrogen separator 21. Hydrogen containing as gaseous impurities hydrogen sulfide, ammonia, and water exits through line 22, psses through the compressor 24 and flows to gas separator 25 through line 26. From the separator, ammonia is removed through line 27 and can be recovered by condensing means as known to the art (not shown). Hydrogen sulfide is removed through line 28 and water through line 29. Purified hydrogen passes through line 30 and is recycled to the process through line 31. Advantageously a hydrogen storage tank or surge tank (not shown) is used to insure a continuous stream of hydrogen. From the hydrogen separator 21 slurry is removed through line 34 and passes to dryer 36, which can advantageously be a spray dryer, although other dryers can be used. The dried desulfurized coal product is removed through line 37 and is the primary product of the process. Solvent is recovered through line 38, cooler 40, and is recycled to the process through lines 41, 42 and 8. Solvent reflux is advantageously employed as shown by returning a portion of the solvent from cooler 40 to the hydrogen separator through lines 43 and 44. Suitable piping, valves, electrical switches, pressure gauges and the like will be apparent to those skilled in the art and accordingly are not described in the figure. It will be further understood by those skilled in the art that a reactor of a different design may be used so long as the slurry is contacted with microwave energy within the limits of operation herein described. For example, a convenient and preferred design is a vertically elongated vessel with the slurry inlet near the top and slurry exit near the bottom thereof, with means for maintaining the fluid level in the upper portion of the vessel and with provision for introducing hydrogen in the form of finely dispersed bubbles near the bottom of the vessel as by means of a sparger. The hydrogen gas bubbles provide good agitation means. A microwave source or sources is placed in or adjacent to the wall of the vessel so that the intimate mixture of coalsolvent-hydrogen is subjected to the influence of microwave energy within the limits herein described.

EXAMPLE 1

A Pittsburgh coal having 1.3 wt. % sulfur, 1.6 Wt. % nitrogen, 6.2 Wt. % oxygen, and about 6 Wt. % free moisture, is pulverized to a particle size so that 90% pass a 100 mesh screen. The coal particles are heated to 250° F. for 40 minutes to remove free moisture and are slurried in a petroleum distillate fraction consisting substantially of paraffinic hydrocarbons boiling in the range of from about 400° F. to 500° F. The ratio of coal to solvent is 1:1 by weight. The slurry is then introduced into an autoclave reactor fitted with a stirrer and with a microwave generator. Hydrogen is introduced into the reactor to a pressure of about 500 psi. At ambient temperature, about 70° F., the coal-hydrogen mixture is subjected to microwave energy at 1,000 gigacycles for about 1minute while mild agitation is provided by the stirrer. The slurry is removed from the reactor and the coal separated therefrom has a reduced sulfur content to about 0.07 Wt. % Hydrogen consumption is about 3,100 scf (standard cubic feet) per ton of coal used, of which about 360 scf go into producing hydrogen sulfide and 2740 scf into producing water; for complete conversion of the sulfur and oxygen in this Example a total of 3260 scf (standard cubic feet) of hydrogen is required.

EXAMPLE 2

The procedure of Example 1 is repeated except that, in drying the coal, it is heated only to 200° F., and subjected to a vacuum of about ½ atmosphere for 20 minutes. The pressure is brought back to atmospheric by the introduction of hydrogen, and the hydrogen atmosphere maintained while the solvent of Example 1 is added to form a slurry having a coal-solvent ratio of about 1:1. The exposure to microwave energy is about 30 seconds at ambient temperature during mild mechanical agitation. The sulfur content of the coal is reduced to below about 0.02 Wt. %.

It is believed that the use of a vacuum in drying the coal and the bringing up to pressure with hydrogen results in the excellent distribution of hydrogen into and through the coal particles which are not significantly displaced by the solvent, so that the hydrogen is adjacent at least most of the sulfur atoms and is available for reaction therewith when the wave energy is applied.

In the process of this Example 2, it is advantageous to use a single vessel for drying, forming the slurry with solvent, introducing hydrogen, and subjecting the coal-hydrogen mixture to wave energy.

EXAMPLE 3

An Illinois coal of 11,480 BTU/lb., water content of 12.1 wt. %, and having a weight percent on a dry basis the following: sulfur = 2.3, oxygen = 18.6 and nitrogen = 1.3, is ground to 100 mesh size and dried at 250° F. for about 30 minutes, and mixed with the solvent of Example 1 in a ratio of coal-solvent about 47:53. The coal slurry is divided into three batches and treated as follows:

a. The first coal slurry batch is introduced into a reactor filled with a continuous wave magnetron which has been thoroughly flushed with hydrogen. At 50 psi of hydrogen pressure the coal is subjected to 60 gigacycle microwaves for 30 seconds. The sulfur and oxygen contents are reduced to 0.35 and 15.6 Wt. %., respectively, while the nitrogen content remains unchanged. Hydrogen consumption is about 2800 scf per ton of coal.

b. The procedure of (a) of this Example is repeated with the second batch except that the hydrogen pressure is increased to 250 psi. The sulfur and oxygen contents are reduced to 0.1 Wt. % and 12.0 Wt. %, respectively, while the nitrogen content remains unchanged. Hydrogen consumption is about 5760 scf per ton of coal.

c. The procedure of (a) of this Example is repeated with the third batch of coal except that the hydrogen pressure is increased to 3,000 psi. The sulfur and oxygen contents are reduced to 0.03 Wt. % and 7.7 wt. %., respectively, and the nitrogen content is reduced to 0.06 wt. %. The consumption of hydrogen is about 10,300 scf per ton and ammonia production is 30 pounds per ton of coal.

EXAMPLE 4

When Example 1 is repeated using as the solvent a petroleum distillate consisting essentially of paraffinic hydrocarbons boiling between about 400° F. and 700° F., substantially equivalent results are obtained.

What is claimed is:

1. Process for reducing the sulfur and oxygen contents of coal which comprises drying coal particles to a free moisture content of below 0.5% by weight, subjecting a mixture of the dried coal slurried in liquid paraffinic hydrocarbons and hydrogen at a pressure of from 5 psi to 10,000 psi to microwave energy, and recovering coal having reduced sulfur and oxygen contents.

2. Process as in claim 1 wherein hydrogen is circulated in the space between the slurry in the reactor and the microwave source.

3. Process as in claim 2 wherein the linear velocity of the hydrogen in the space between the slurry and the microwave source is at least 1 foot per second.

4. Process for reducing the sulfur, oxygen and nitrogen contents of coal which comprises drying coal particles to a free moisture content of below 0.5% by weight, subjecting a mixture of the dried coal slurried in a solvent and hydrogen at a pressure of from about 2,500 psi to 10,000 psi to microwave energy, and recovering coal having reduced sulfur, oxygen and nitrogen contents.

5. Process according to claim 4 wherein ammonia is recovered from the process as a product thereof.

6. Process for reducing the sulfur content of coal which comprises forming a slurry of dry coal particles in an inert solvent, admixing the coal slurry with hydrogen, and subjecting the coal-solvent-hydrogen mixture to microwave energy wherein said microwave energy is composed of at least two microwave frequencies.

7. Process according to claim 1 wherein the coal-solvent-hydrogen mixture is subjected to the two microwave frequencies simultaneously.

8. Process according to claim 5 wherein the coal-solvent-hydrogen mixture is subjected to the two microwave frequencies.

* * * * *